US005784853A

United States Patent [19]

Hood et al.

[11] Patent Number: 5,784,853

[45] Date of Patent: *Jul. 28, 1998

[54] THERMALLY INSULATING MULTIPANE GLAZING STRUCTURE

[75] Inventors: Thomas G. Hood, San Francisco; Roger F. Iles, San Carlos, both of Calif.; Peter J. Millar, Zephyr Cove, Nev.

[73] Assignee: Southwall Technologies Inc., Palo Alto, Calif.

[ * ] Notice: The term of this patent shall not extend beyond the expiration date of Pat. No. 5,164,894.

[21] Appl. No.: 676,816

[22] Filed: Jul. 8, 1996

Related U.S. Application Data

[63] Continuation of Ser. No. 896,478, Jun. 10, 1992, Pat. No. 5,544,465, which is a continuation-in-part of Ser. No. 389,231, Aug. 2, 1989, Pat. No. 5,156,894.

[51] Int. Cl.[6] ..... E06B 3/663

[52] U.S. Cl. ..... 52/786.13; 52/786.11

[58] Field of Search ..... 52/202, 203, 204.5, 52/204.53, 204.57, 204.591, 204.6, 308, 786.1, 786.11, 786.13, 788.1

[56] References Cited

U.S. PATENT DOCUMENTS

| | | | |
|---|---|---|---|
| 2,838,809 | 6/1958 | Zeolla et al. . | |
| 3,499,697 | 3/1970 | Edwards . | |
| 3,523,547 | 8/1970 | Edwards . | |
| 3,630,809 | 12/1971 | Edwards . | |
| 3,791,910 | 2/1974 | Bowser . | |
| 3,837,129 | 9/1974 | Losell | 52/786.11 X |
| 3,928,953 | 12/1975 | Mazzoni et al. | 52/786.13 X |
| 3,935,351 | 1/1976 | Franz . | |
| 3,978,273 | 8/1976 | Groth . | |
| 4,019,295 | 4/1977 | Derner et al. . | |
| 4,047,351 | 9/1977 | Derner et al. . | |
| 4,120,999 | 10/1978 | Chenel et al. . | |
| 4,158,278 | 6/1979 | Cardinale et al. | 52/786.13 |
| 4,242,386 | 12/1980 | Weinlich . | |
| 4,334,398 | 6/1982 | Grether . | |
| 4,334,941 | 6/1982 | Neely, Jr. . | |
| 4,335,166 | 6/1982 | Lizardo et al. . | |
| 4,337,990 | 7/1982 | Fan et al. . | |
| 4,368,226 | 1/1983 | Mucaria . | |
| 4,369,084 | 1/1983 | Lisec . | |
| 4,393,105 | 7/1983 | Kreisman . | |
| 4,413,877 | 11/1983 | Suzuki et al. . | |
| 4,431,691 | 2/1984 | Greenlee . | |
| 4,433,016 | 2/1984 | Neely, Jr. et al. . | |
| 4,459,789 | 7/1984 | Ford . | |
| 4,468,905 | 9/1984 | Cribben . | |
| 4,479,988 | 10/1984 | Dawson . | |
| 4,520,611 | 6/1985 | Shingu et al. . | |
| 4,536,424 | 8/1985 | Laurnet . | |
| 4,536,998 | 8/1985 | Matteucci et al. . | |
| 4,563,843 | 1/1986 | Grether et al. . | |
| 4,579,638 | 4/1986 | Scherber . | |
| 4,604,840 | 8/1986 | Mondon . | |
| 4,639,069 | 1/1987 | Yatabe et al. . | |
| 4,687,687 | 8/1987 | Terneu et al. . | |
| 4,710,411 | 12/1987 | Gerace et al. . | |
| 4,721,636 | 1/1988 | Hood et al. . | |

(List continued on next page.)

FOREIGN PATENT DOCUMENTS

| | | |
|---|---|---|
| 2011985 | 7/1979 | United Kingdom . |

OTHER PUBLICATIONS

Arasteh, "Superwindows" *Glass Magazine* (May 1989) pp. 82–83.

*Primary Examiner*—Carl D. Friedman
*Assistant Examiner*—Kevin D. Wilkens
*Attorney, Agent, or Firm*—Burns,Doane,Swecker & Mathis, L.L.P.

[57] ABSTRACT

Multipane, insulating glazing structures having exceptional thermal insulation performance are provided. The multipane structures comprise two substantially parallel rigid glazing sheets spaced apart by an interior spacer which includes a physically stable body of low thermal conductivity, closed cell, foamed polymer.

13 Claims, 10 Drawing Sheets

U.S. PATENT DOCUMENTS 4,754,585 7/1988 Rundo ..... 52/202
4,756,783 7/1988 McShane ..... 52/209 X
4,807,419 2/1989 Hodeket al. .
4,815,245 3/1989 Gartner .
4,831,799 5/1989 Glover et al. .
4,950,344 8/1990 Glover et al. ..... 52/786.1 X
5,007,217 4/1991 Glover et al. ..... 52/172
5,087,489 2/1992 Lingemann ..... 52/786.13 X
5,156,894 10/1992 Hood et al. .
5,544,465 8/1996 Hood et al. ..... 52/786.11 X

THERMALLY INSULATING MULTIPANE GLAZING STRUCTURE

REFERENCE TO RELATED APPLICATIONS

This is a continuation of U.S. Ser. No. 07/896,478 filed Jun. 10, 1992 (now U.S. Pat. No. 5,544,465) which is in turn a continuation-in-part of U.S. Ser. No. 389,231 filed Aug. 2, 1989 (now U.S. Pat. No. 5,156,894)

TECHNICAL FIELD

The present invention relates generally to multipane glazing structures, and more particularly relates to the use of thermally insulative spacers in novel multipane glazing structures which have exceptional thermal insulation performance. The invention also relates to the interpane spacers.

BACKGROUND

Multipane glazing structures have been in use for some time as thermally insulating windows, in residential, commercial and industrial contexts. Examples of such structures may be found in U.S. Pat. Nos. 3,499,697, 3,523,847 and 3,630,809 to Edwards, 4,242,386 to Weinlich, 4,520,611 to Shingu et al., and 4,639,069 to Yatabe et al. While each of these patents relates to laminated glazing structures which provide better insulation performance than single-pane windows, increasing energy costs as well as demand for a superior product have given rise to a need for windows of even higher thermal insulation ability.

A number of different kinds of approaches have been taken to increase the thermal insulation performance of windows. Additional panes have been incorporated into a laminated structure, as disclosed in several of the above-cited patents; typically, incorporation of additional panes will increase the R-value of the structure from R-1 for a single-pane window to R-2 for a double laminate, to R-3 for a structure which includes 3 or more panes (with "R-values" defined according to the insulation resistance test set forth by the American Society for Testing and Materials in the *Annual Book of ASTM Standards*). Southwall Technologies Inc., the assignee of the present invention, has promoted such a triple-glazing structure which employs two glass panes containing an intermediate plastic film. Such products are described, for example, in U.S. Pat. No. 4,335,166 to Lizardo et al.

In multiplane structures two or more glazing panes are positioned in a spaced parallel relationship to one another by reason of spacers located at the periphery of the glazing panes. An effective spacer should have structural integrity and a substantial level of crush strength so as to allow a dimensionally stable window unit to be formed.

Spacers used heretofore have ranged from solid or open metal or plastic constructs to hollow metal, plastic, or composite tubes of circular, rectangular or irregular cross-sections, with continuous or discontinuous peripheries. Hollow spacers are often filled with desiccant to minimize interpane water content and condensation problems in the inner surface of the panes.

Examples of spacers in the art include U.S. Pat. Nos. 3,935,351 to Franz, 4,120,999 to Chenel et al., 4,431,691 to Greenlee, 4,468,905 to Cribben, 4,479,988 to Dawson and 4,536,424 to Laurent relate to spacers for use in multipane window units.

In this application's commonly assigned parent, U.S. patent application Ser. No. 389,231, filed 2 Aug., 1989, it is disclosed that a closed-cell polymer foam spacer can be employed to an advantage as a spacer in multipane windows and especially in high performance, gas-filled quadruple-pane glazing structures. References to spacers made from other types of foams include U.S. Pat. Nos. 4,563,843 to Grether et al. and 4,831,799 to Glover et al.

As higher and higher R values are demanded from multipane window units, there is an increasing need to minimize or at least reduce the conduction of heat through the edge spaces whenever possible. This invention addresses this need.

Despite the increasing complexity in the design of insulating window structures, total window R-values have not surpassed 4 or 5. While not wishing to be bound by theory, the inventors herein postulate several reasons for the limited insulating performance of prior art window structures: (1) thermal conductance across interpane spacers as discussed above present at the window edge; (2) thermal conductance within and across the edge sealant; and (3) the impracticality, due to considerations of window weight and thickness, of having a large number of panes in a single glazing structure.

The present invention addresses each of the aforementioned problems and thus provides a novel multipane window structure of exceptionally high thermal insulating performance.

In addition to insulating performance, the following characteristics are extremely desirable in a window structure and are provided by the present invention as well:

durability under extremes of temperature;

resistance of internal metallized films to yellowing;

resistance to condensation, even at very low temperatures;

low ultraviolet transmission; and good acoustical performance, i.e., sound deadening within the multilaminate structure.

CITATION OF PRIOR ART

In addition to the references noted in the preceding section, the following patents and publications relate to one or more aspects of the present invention.

Multipaned glazing units: U.K. Patent Application Publication No. 2,011,985A describes a multiple glazed unit containing one or more interior films. The unit may in addition include sound damping materials and a gas filling. U.S. Pat. No. 4,687,687 to Terneu et al. describes a structure containing at least one sheet of glazing material coated with a layer of a metallic oxide. U.S. Pat. No. 2,838,809 to Zeolla et al. is a background reference which describes multiple glazing structures as windows for refrigerated display cases. U.S. Pat. Nos. 4,807,419 to Hodek et al. and 4,815,245 to Gartner also relate to multiple pane window units.

Heat-reflective, low-emissivity ("low e") coatings have been incorporated into one or more panes of a window structure, increasing the R-value to 3.5 or higher. Such a heat-reflective coating is described, for example, in U.S. Pat. No. 4,337,990 to Fan et al. (which discloses coating of a plastic film with dielectric/metal/dielectric induced transmission filter layers). Window structures which include heatreflective coatings are described in U.S. Pat. Nos. 3,978,273 to Groth, 4,413,877 to Suzuki et al., 4,536,998 to Matteucci et al., and 4,579,638 to Scherber.

Still another and more recent method which has been developed for increasing the thermal insulation performance of windows is the incorporation, into the window structure, of a low heat transfer gas such as sulfur hexafluoride (as described in U.S. Pat. No. 4,369,084 to Lisec), argon (as described in U.S. Pat. Nos. 4,393,105 to Kreisman and 4,756,783 to McShane), or krypton (also as disclosed in McShane '783). These gas-filled laminated windows are reported to have total window R-values of 4 or 5, with the total window R-value approximating the average of the center-of-glass and edge area R-values (Arasteh, "Superwindows", in *Glass Magazine*, May 1989, at pages 82–83).

U.S. Pat. Nos. 4,019,295 and 4,047,351 to Derner et al. disclose a two-pane structure containing a gas filling for acoustic insulation purposes. U.S. Pat. No. 4,459,789 to Ford describes a multi-pane, thermally insulating window containing bromotrifluoromethane gas within the interpane spaces. U.S. Pat. No. 4,604,840 to Mondon discloses a multipane glazing structure containing a dry gas such as nitrogen in its interpane spaces. U.S. Pat. No. 4,815,245 to Gartner, cited above, discloses the use of noble gases to fill interpane spaces.

Sealants: U.S. Pat. Nos. 3,791,910 to Bowser, 4,334,941 and 4,433,016 to Neely, Jr., and 4,710,411 to Gerace et al. describe various means for sealing multipane window structures.

SUMMARY OF THE INVENTION

It is a primary object of the invention to address the above-noted deficiencies of the prior art and thus to provide a multipane window structure of exceptionally high thermal insulation performance.

It is still another object of the invention to provide a novel interior (i.e., interpane) spacer for use in multipane window structures.

Additional objects, advantages and novel features of the invention will be set forth in part in the description which follows, and in part will become apparent to those skilled in the art upon examination of the following, or may be learned by practice of the invention.

In one aspect of the invention, a multipane glazing structure comprises at least two substantially parallel sheets of glazing held in spaced relationship to each other by a peripheral spacer, said spacer comprised of a closed cell foamed polymer having a thermal conductivity of less than about 0.8 BTU per in×ft$^2$×hr×°F., as measured by ASTM Test C518. The closed cell foam element in the spacer provides a thermal break across the spacer. In this aspect, the closed cell foam element can be accompanied by an additional spacer element such as a conventional spacer, for example, a hollow tube, a solid body, an irregularly shaped spacer, or the like.

In other aspects of the invention, multipane glazing structures are provided with a foam spacer as above, and further can include a peripheral seal surrounding and enclosing the outside edges of the glazing sheets and the spacers, additional sheets of glazing in parallel orientation, gas filling of the space between the parallel sheets, and the like. The peripheral seal can comprise (a) a layer of curable sealant adhered to the edges of the sheets of glazing and to the outer surface of the spacers, and (b) a continuous gas-impermeable tape adhered to and overlaying the layer of sealant. In a preferred embodiment, the polymeric foam spacer extends beyond the edges of the glazing sheets to the exterior tape so as to provide a thermal break within the sealant.

DESCRIPTION OF THE FIGURES

This invention will be further described with reference being made to the accompanying drawings. In these drawings, common numbering for common elements will be used from figure to figure.

In the drawings.

DETAILED DESCRIPTION OF THE INVENTION

The glazing structures of the invention include two substantially parallel rigid sheets of glazing spaced apart from each other by a peripheral polymeric spacer.

Figure 1:
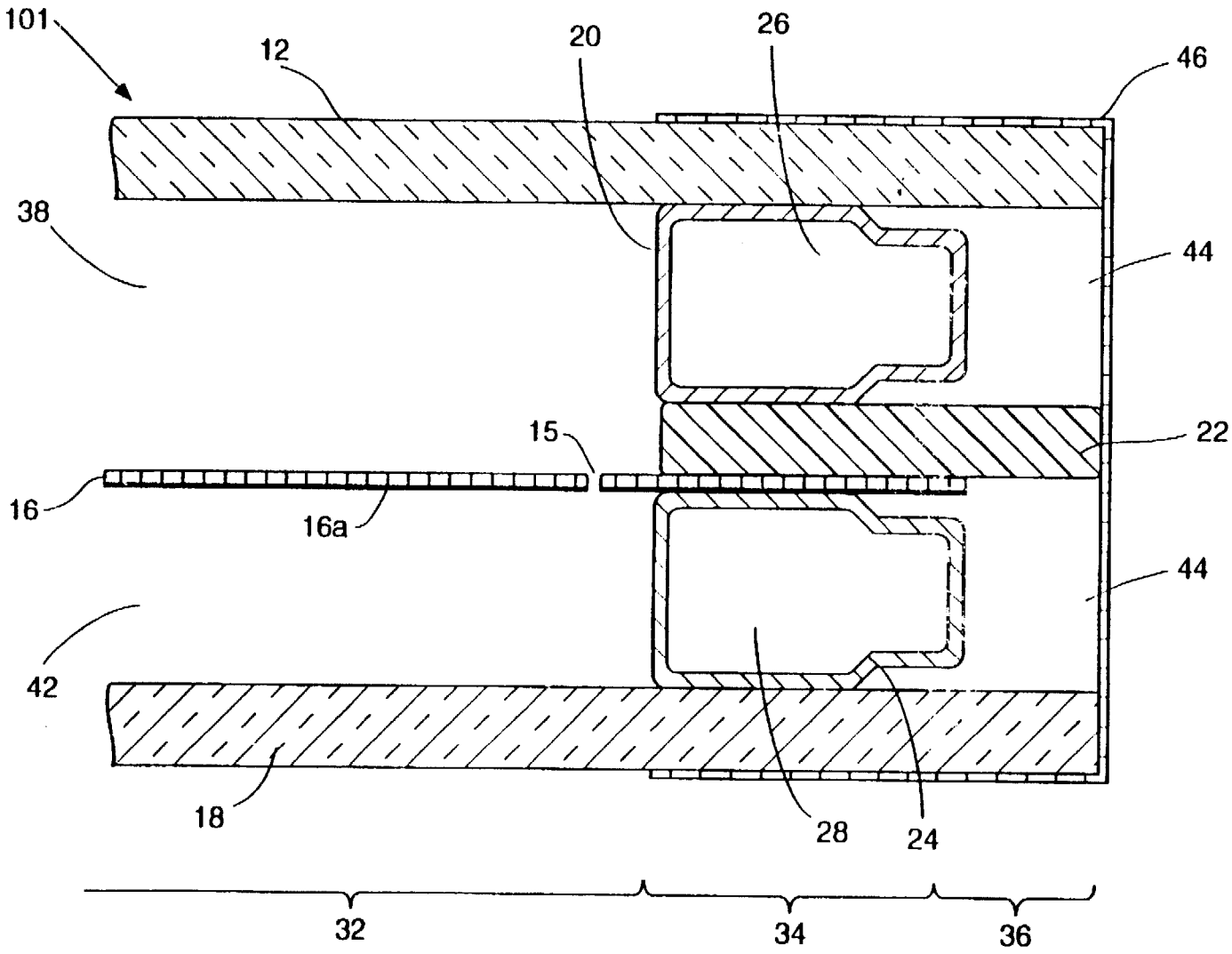
FIG. 1 is a schematic cross-sectional representation of one multipane glazing structure of this invention.

Turning now to FIG. 1, a multipane window structure according to the invention is shown generally as 101. The multipane structure 101 contains three distinct, substantially parallel glazing sheets 12, 16 and 18 spaced apart from one another by spacers 20, 22 and 24. Spacer 22 is a closed cell polymeric foam spacer having a thermal conductivity of less than 0.8 BTU per in×ft$^2$×hr×°F. The first and third glazing sheets 12 and 18, which represent the exterior panes of the structure, can be of a rigid plastic material such as a rigid acrylic or polycarbonate, but more commonly these sheets are glass. Depending on architectural preference, one or both of these exterior panes can be coated, tinted or pigmented. This can be done to enhance appearance, to alter light-transmission properties, to promote heat rejection, to control ultraviolet transmission, or to reduce sound transmission. Bronze, copper or grey tints are often applied to the outer of the two glass panels. The outer glazing sheets 12 and 18 can also be of a special nature, e.g., laminated, tempered, etc. Typically, the thickness of these outer sheets will be in the range of about 1/16" to about 1/4".

Interior glazing sheet 16 is shown as a flexible plastic sheet, although, like the outer glazing sheets, it can also be comprised of glass or coated glass. If plastic, the material should be selected so as to have good light stability so that it will withstand the rigors of prolonged sun exposure. This plastic should also be selected so as not to be substantially susceptible to outgassing, which could lead to deposits on the inner surfaces of the glass layers and interfere with optical clarity. Polycarbonate materials and the like can be used, but there is a preference for the polyesters, such as polyethylene terephthalate (PET). These interior plastic films are relatively thin as compared with other typical window-film materials. Thicknesses above about 1 mil (0.001") are generally used, with thicknesses in the range of about 2 mil to about 25 mil being preferred and thicknesses in the range of about 2 mil to 10 mil being more preferred.

It is preferred that the interior glazing sheet 16 be provided with one or more apertures 15 to enable equalization of pressure between the interpane gas spaces. Such apertures also allow desiccant present in the interior of spacers 26 and 28 to absorb vapor from space 38 as well as from space 42.

In embodiment 101, the interior glazing sheet 16 is coated on one of its sides with heat-reflective layers as known in the art (element **16*a*, in FIG. 1) and as exemplified in U.S. Pat. No. 4,337,990 to Fan et al., cited hereinabove. Two or more such heat reflective layers may be used but commonly only one such coating is present. Such coatings can be designed to transmit from about 40% to about 90% of the visual light impacting them. It is preferred to use as such coatings a dielectric/metal/dielectric multilayer induced transmission filter as described in commonly assigned U.S. Pat. No. 4,799,745, issued Jan. 24, 1989. These layers can be laid down by magnetron sputtering techniques which are known to the art. Southwall markets a range of induced transmission heat reflective film products under its HEAT MIRROR trademark. These materials have various thicknesses of metal (often silver) sandwiched between layers of dielectric and are designed to give substantial heat reflection and typically transmit from about 10 to 90% of total visible light. Reflector 16***a* can be on either or both sides of film 16. It may be eliminated if desired.

Spacers 20 and 24 may be selected from a wide variety of commercially available materials. These spacers are typically metallic, plastic, or composite (i.e., plastic plus fiberglass, plastic plus metal) or the like, as is well known in the art. Spacers 20 and 24 are generally fabricated so as to have hollow interiors 26 and 28 containing desiccant in order to prevent buildup of moisture between the layers. The desiccant may or may not be present within the interior spacers 26 and 28. The spacer structures 20 and 24 of FIG. 1 are merely representational; generally rectangular or square cross-sections will be employed. The exact shape of the spacers 20 and 21 can vary substantially. In addition to the irregularly shaped but hollow structure shown in FIG. 1, other structures such as a U-shaped or double-U-shaped cross-section material can be employed, as well as other spacers known in the art.

As noted above, spacer 22 is comprised of a closed cell foam polymer having a thermal conductivity of less than about 0.8, preferably less than about 0.5, most preferably less than about 0.2 BTU per in×ft$^2$×hr×°F. The closed cell foam material should be firm with a compressive strength of at least about 100 psi; to this end, the material preferably has a density of at least about 3.0 lb/ft$^3$, typically in the range of about 3.0 to about 6.0 or 7.0 lb/ft$_3$ and could range from 3.0 to 25 lb/ft$^3$. The material should not be such that it is outgasses significantly, and should, in general, be chemically and physically stable. Exemplary materials for use as interior spacer 22 include foamed polyurethanes, foamed polycarbonate, foamed polyvinyl chloride (PVC) modified so as to prevent outgassing (e.g., using a steam process as known in the art), or synthetic thermoplastic resins manufactured under the trademark "Noryl" (polyphenylene oxide) by the General Electric Corporation. Excellent spacers are made from closed cell foam polymers marketed by Polimex under the name Klegecell II, and as Polimex TR, and by DIAB BARRACUDA under the name Divinyl Cell HT.

In the embodiment 101, in FIG. 1, closed cell foam spacer 22 extends all the way to the outer periphery of the glazing unit, thus providing a thermal break across the edge seal.

Figure 11:
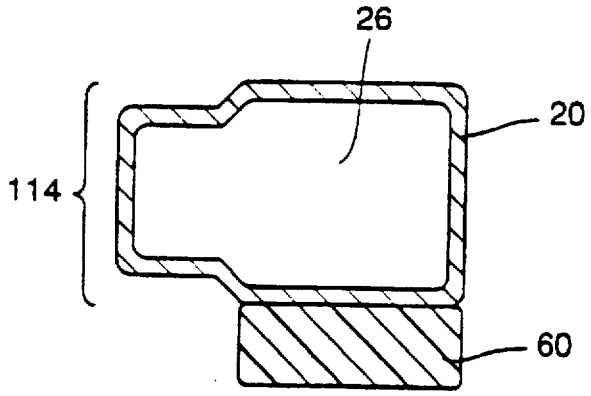
Figure 12:
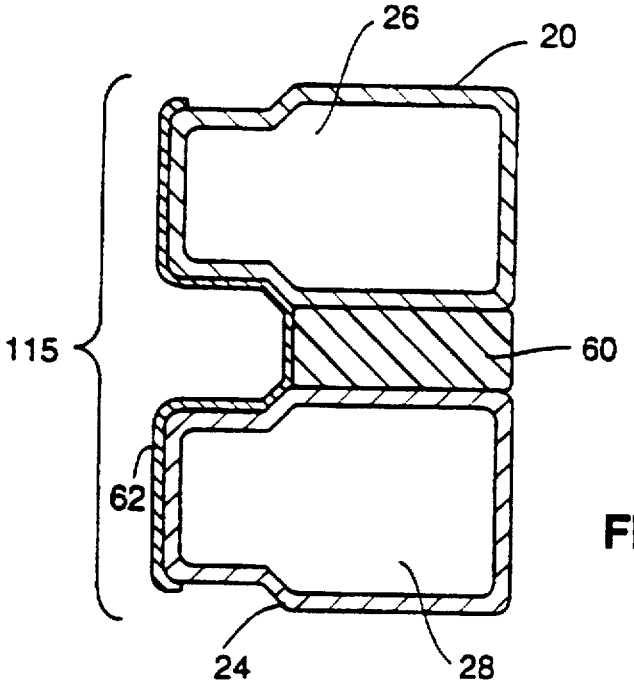

Commonly, the thickness of the spacer materials is controlled; for example, in FIG. 1 the overall thickness of the glazing unit should commonly be kept to below about 2 inches, preferably below about 1.5 inches, and more preferably at about 1 inch or below. Thus, the space between glazing elements 16 and 12 should range from about 1.5 inches to about ⅜ of an inch. In this spacing, the thickness of foam layer 22 should be at least about ⅛ of an inch, but not the entire distance between a pair of glazing surfaces. As illustrated in FIG. 1 and FIG. 11 and FIG. 12, foam spacer 22 can occupy from about 10% of the space between a pair of glazing layers up to and including as much as 75 or 80% or more. In copending parent application Ser. No. 389,231, embodiments are shown where a foam spacer spans the entire distance between a pair of glazing sheets. Typical thicknesses, measured in the glazing sheet-to-glazing sheet direction for the foam spacer 22 range from about 1/16 of an inch to about ¾ of an inch, and especially from about ⅛ of an inch to about ½ of an inch.

Figure 13:
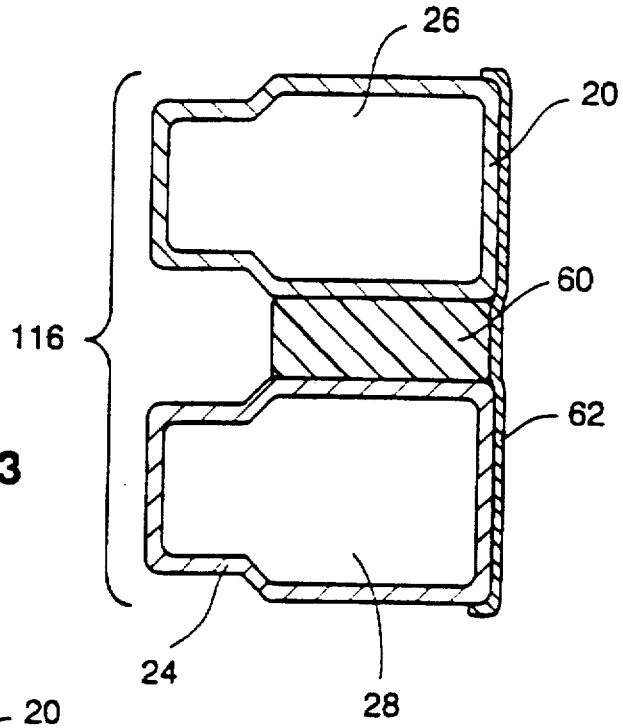
FIG. 13 is a perspective end view of a typical foam spacer as is employed in the glazing structures of this invention.

As shown in FIG. 13, it is preferred that the exposed surfaces of the foam 60 of spacer 22 be covered in metallized foil 62 to ensure that gas loss through the spacer is minimized and to protect the spacer from ultraviolet rays. Foil 62 is typically comprised of aluminum, silver, copper or gold deposited on a polyester or other polymeric substrate. Generally, metallized foil 62 will have a thickness in the range of 0.5 to 3 mils.

Interpane voids 38, 40 and 42 which result from the spacing apart of the three glazing sheets are filled with a gas selected to reduce heat conductance across the window structure. Virtually any inert, low heat transfer gas may be used, including krypton, argon, sulfur hexafluoride, carbon dioxide, or the like, at essentially the atmospheric pressure prevailing at the location of use of the window unit. It is particularly preferred that the gas filling have a high krypton content, of at least about 10%, more preferably at least about 25%, most preferably at least about 50%, depending on the thickness of the window structure (thicker windows with thicker voids would not typically employ as high a krypton content as a thinner window).

It is also preferred that the filling gas contain some appreciable amount of oxygen (preferably in the range of about 1% to 10% by volume, more preferably in the range of about 2% to 5% by volume). Incorporation of oxygen into the filling gas tends to prevent or minimize yellowing of the interior plastic glazing sheet 16.

Sealant 44 is present between glazing sheets 12 and 18 at their edges. This sealant should be a curable, high-modulus, low-creep, low-moisture-vapor-transmitting sealant. It should have good adhesion to all of the materials of construction (i.e., metal or plastic, glass, metallized interior films, and the like). Polyurethane adhesives, such as the two-component polyurethanes marketed by Bostik (Bostik "3180-HM" or "3190-HM"), are very suitable. These adhesives are merely representative, and the invention is not limited to the use of these adhesives, particularly in constructions where no film glazing, such as 16 in FIG. 1, is employed.

The peripheral seal of window structure 101 is formed both by sealant 44 and by continuous layer 46 of a gas-impermeable tape which adheres to and overlays the sealant. The tape is preferably comprised of a multilayer plastic packaging material which acts as a retaining barrier for the gas filling in the window structure. The tape is of a material selected so as to be hydrolytically stable, resistant to creep, and, most importantly, highly resistant to vapor transmission. Exemplary materials useful as tape 46 include metal-backed tapes in general as well as butyl mastic tapes, mylar-backed tapes, and the like. It is particularly preferred that the adhesive component of the tape be a butyl adhesive. The thickness of the sealing tape is preferably in the range of about 5 to 30 mils, more preferably in the range of about 10 to 20 mils.

The peripheral seal formed by the curable sealant/gas-impermeable tape system ensures that there is virtually no gas leakage from the window, on the order of 1% per year or less. This is in contrast to prior art methods of sealing gas-filled glazing structure, which can result in gas leakage as high as 20% to 60% per year.

As may be deduced from FIG. 1, thermal conductivity across the window structure may occur in three regions:

across the central portion 32 of the window; across the metallic edge spacers, identified as region 34 in the Figure; or through the very edge of the structure, across the sealant (identified as region 36 in the Figure). The use of multiple panes, reflective coatings and gas fill reduces the conductivity in the 32 region and the closed cell foam spacer of the present invention reduces the thermal conductivity in all regions 34 and 36, and thus improves insulation performance while significantly reducing the problem of condensation.

With respect to region 34, conductivity across the exterior metallic spacers is significantly reduced by the presence of foam spacer 22 which has, as noted above, very low conductivity.

With respect to region 36, conductivity across sealant 44 is significantly reduced by foam spacer 22, which, as shown, extends to the very edge of the glazing structure so that its "end" extends beyond the edges of the interior glazing sheets and is aligned with the edges of exterior sheets 12 and 18. Extension of interior spacer 22 in this way provides virtually complete thermal break at the edge of the glazing structure so as to substantially reduce thermal conductivity across and through the sealant 44. This aspect of the invention can significantly improve insulation performance and resistance to condensation.

Alternative structures for the foam spacer containing windows of this invention are illustrated in FIGS. 2–12.

Figure 2:
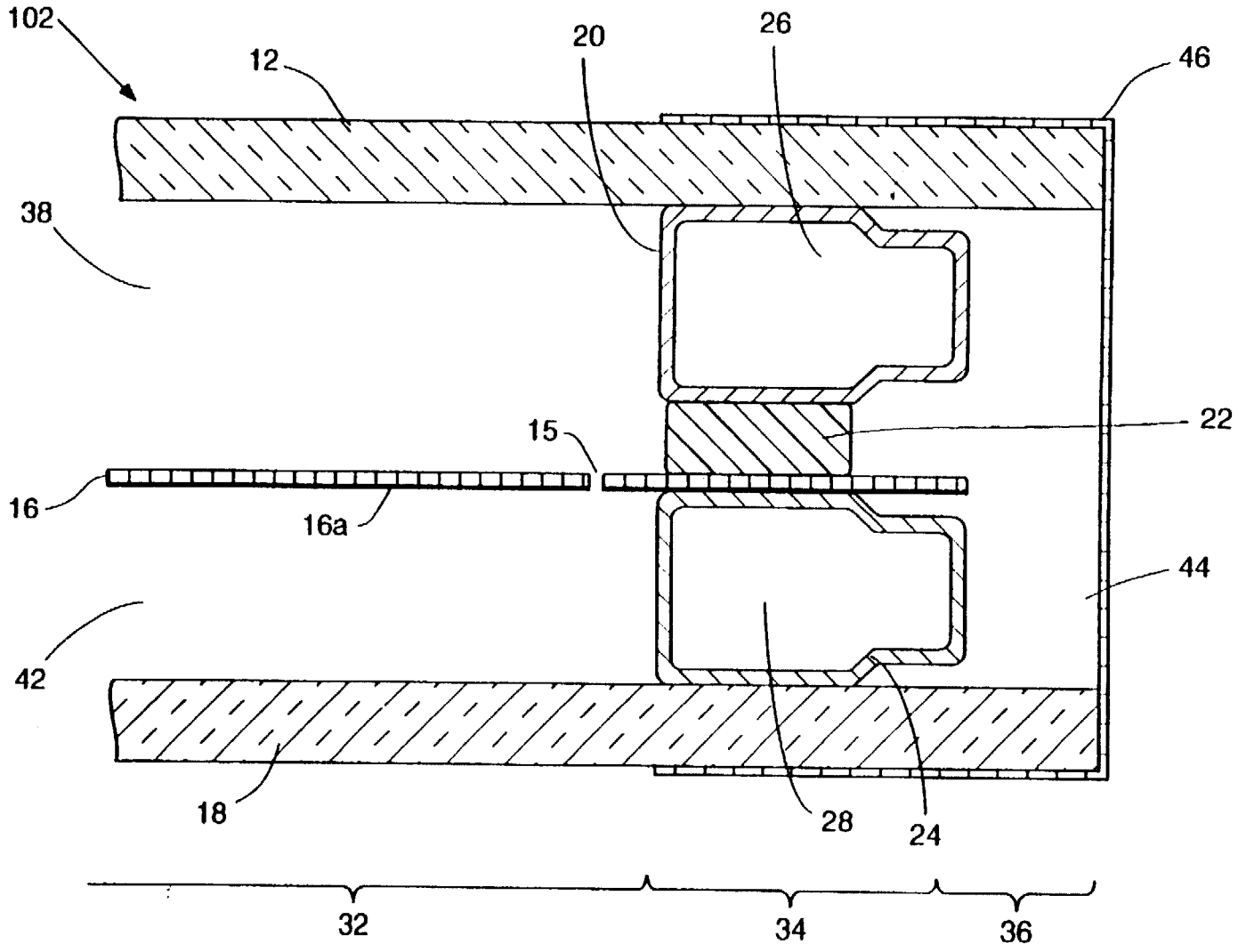
FIGS. 2–12 each are schematic cross-sectional views of additional embodiments of the multipane glazing structure of this invention.

In FIG. 2, glazing structure 102 is shown. It is similar to structure 101 just described but employs a foam spacer 22 which does not extend all the way through seal 44 to the outside edge of the structure. This configuration may be somewhat less efficient than that of structure 101 but may offer manufacturing advantages.

Figure 3:
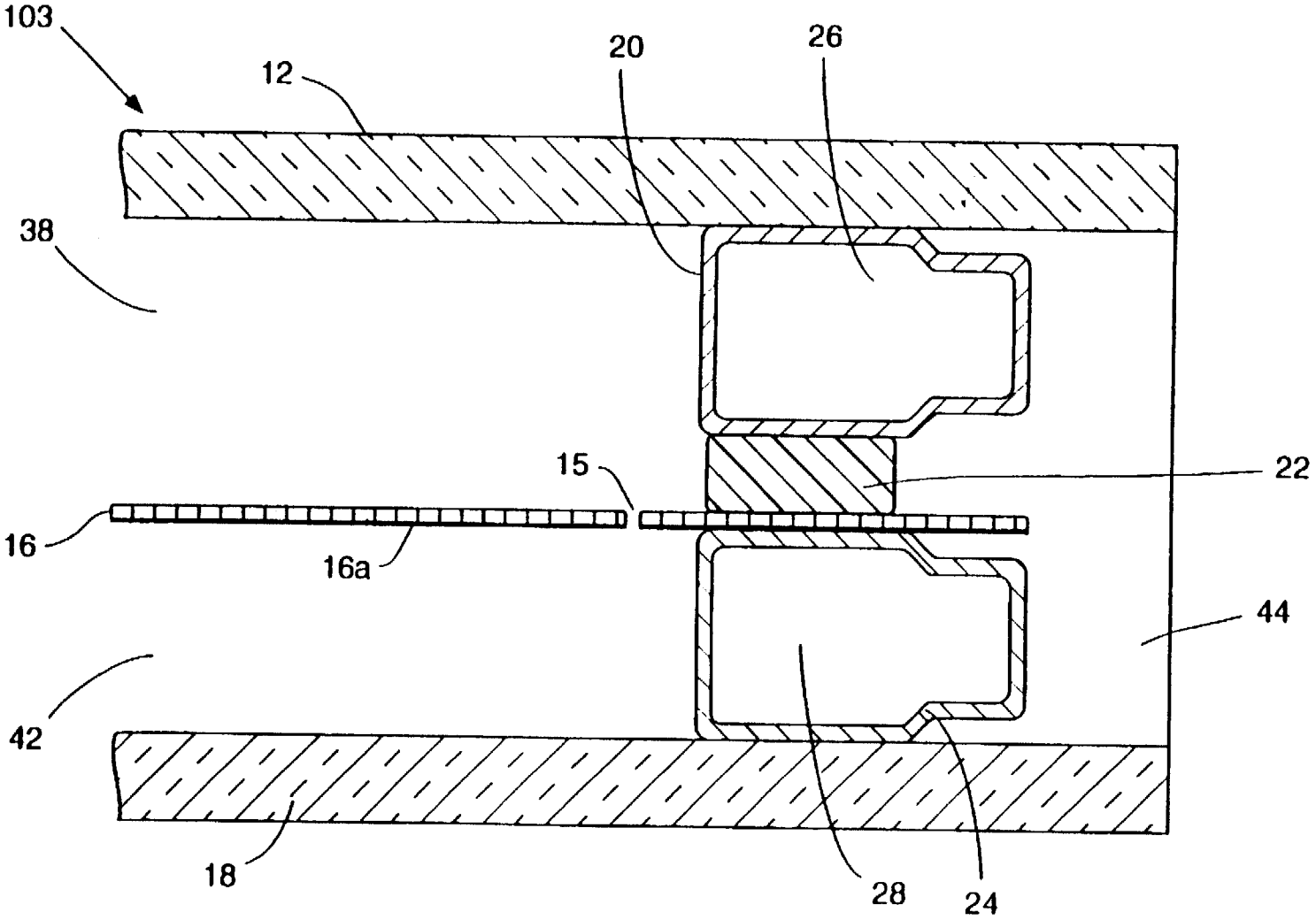

Structure 103, shown in FIG. 3, is similar to structure 101 and 102 but it lacks the exterior sealant film 46. This can be done when the window structure is not gas filled so that there is no concern about gas leakage from the unit. It also can be used if a gas-impermeable seal 44 is employed.

Figure 4:
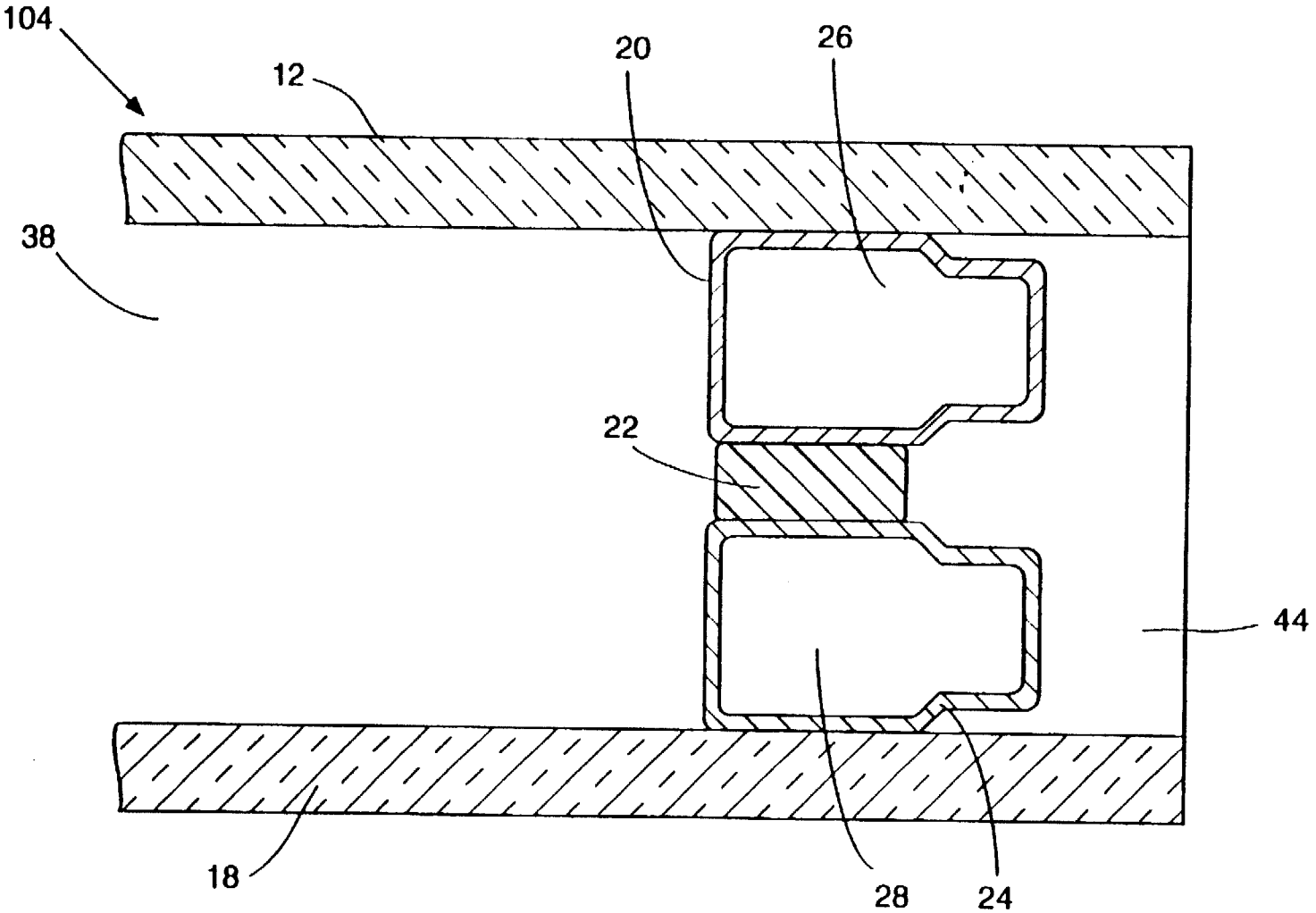

Structure 104, shown in FIG. 4 shows an additional simplification structure 103 in which the interim film 16 is omitted. Removing interim film 16, particularly with its heat reflective layer 16*a*, does decrease the thermal performance of the overall window unit but it does not reduce the effectiveness of the foam spacer 22 of the invention.

Figure 5:
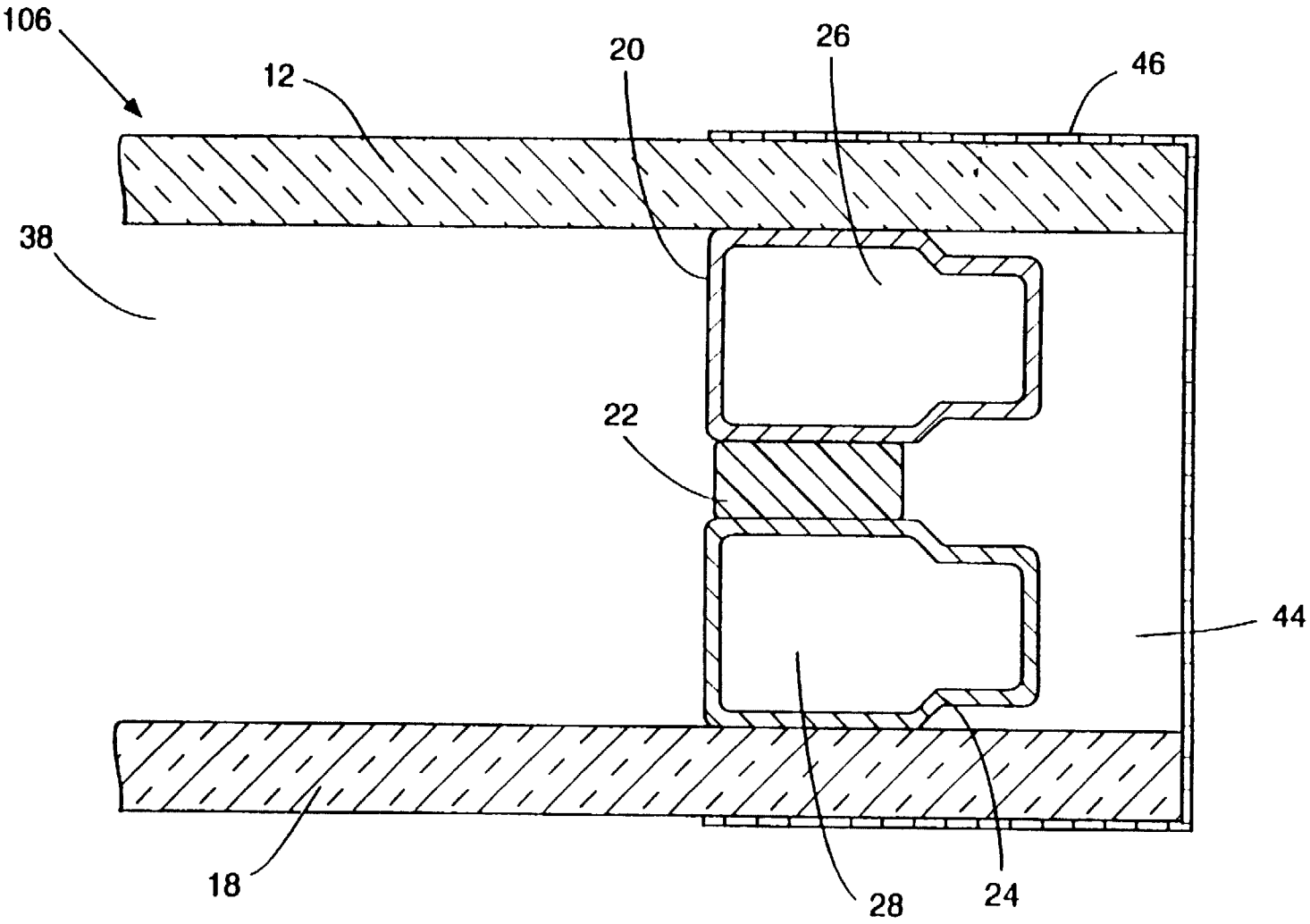

Structure 105, shown in FIG. 5 is a variation in structure 104 in that it includes foam spacer 22 but allows the spacer to protrude to the edge of the glazing unit for the advantages this provides. Structure 105 also optionally includes outer seal 46 which, as already discussed, facilitates the use of gas filling in the unit by sealing the unit and preventing gas leakage.

Figure 6:
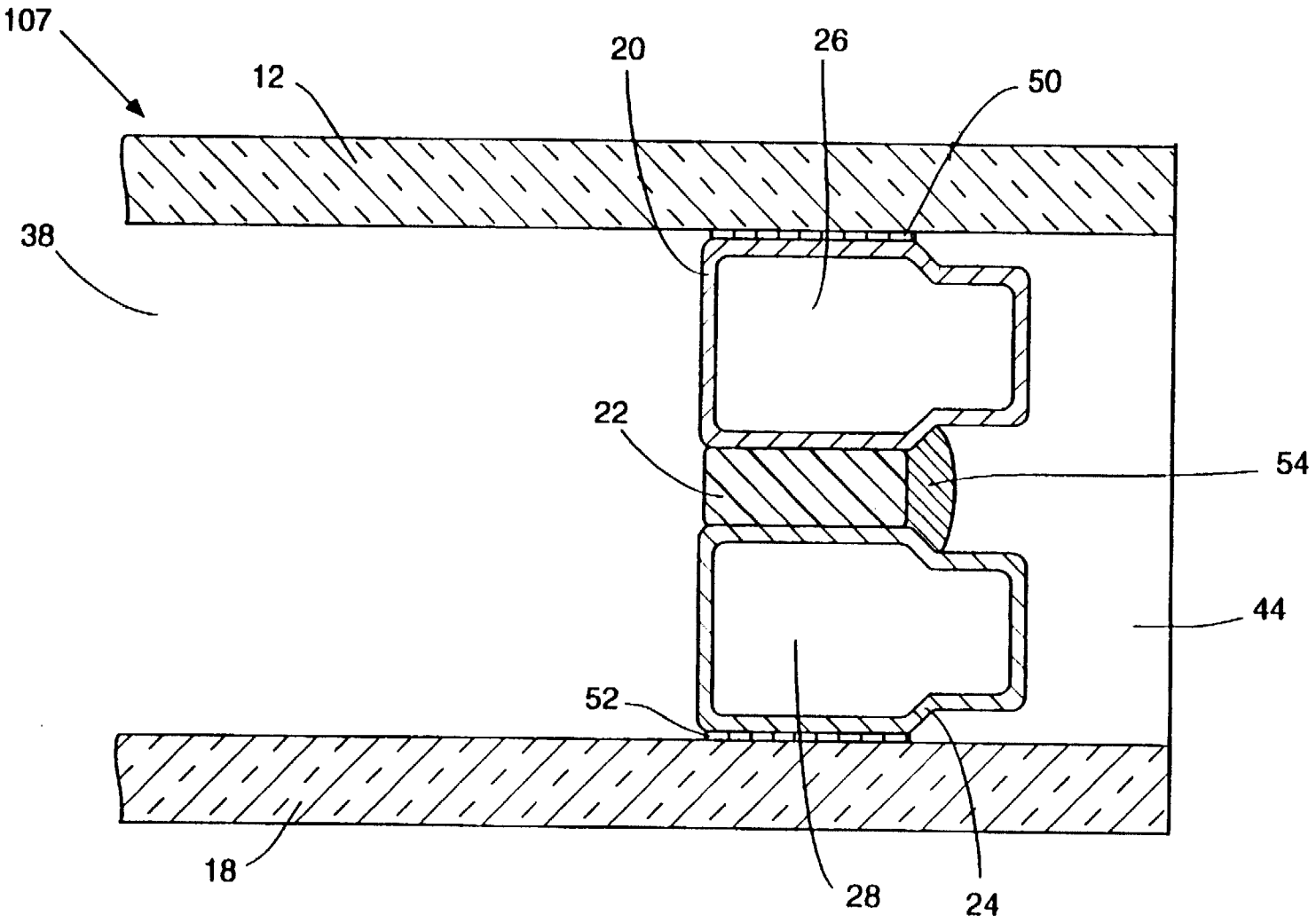

Structure 106 in FIG. 6 includes the outer seal 46 together with the shorter foam spacer 22. Again, seal 46 prevents gas leakage into or out of the glazing structure.

Figure 7:
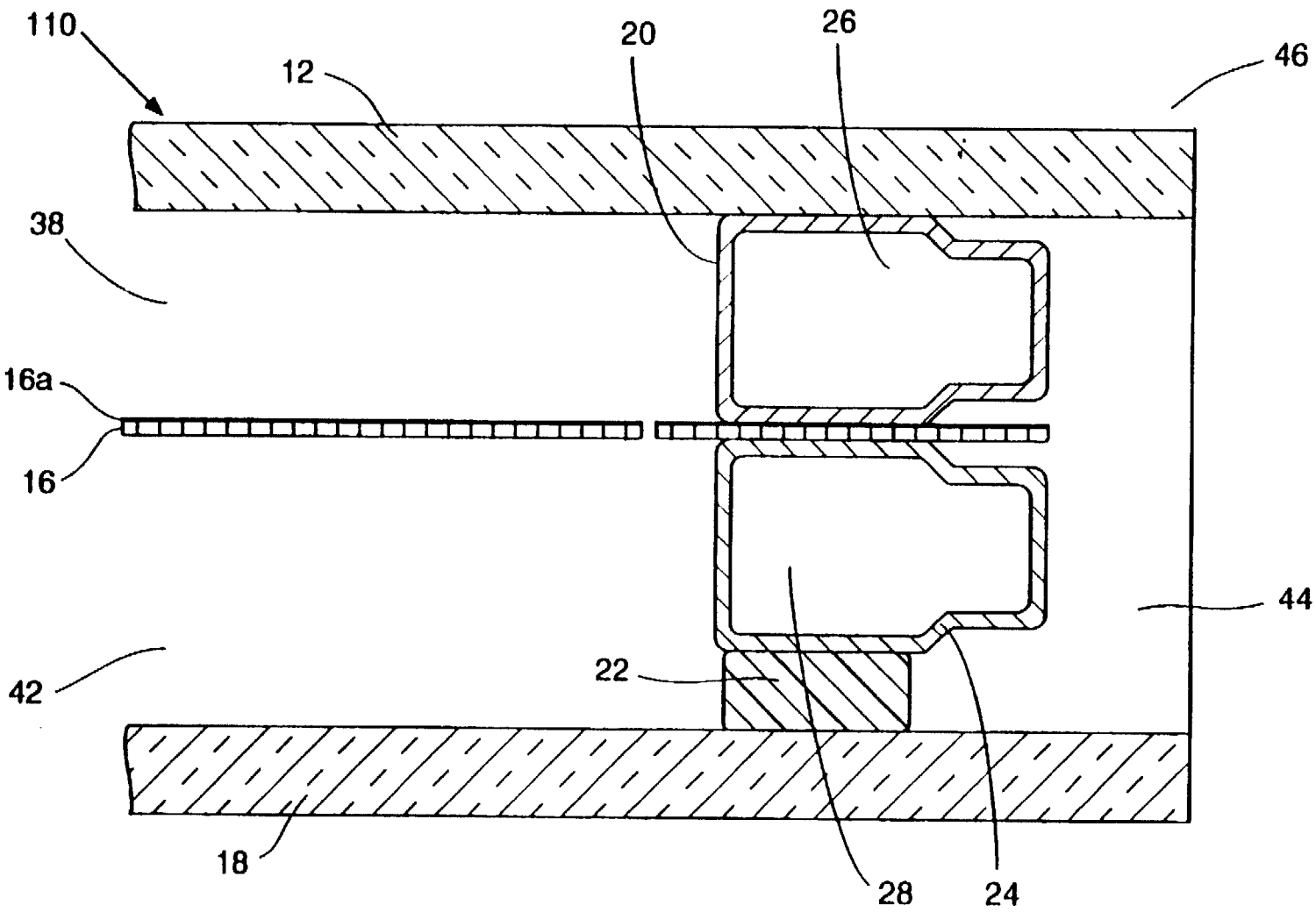

Structure 107 in FIG. 7 illustrates another way to achieve a gas tight seal using the closed cell foam spacer in a window. In structure 107 a gas impermeable sealant such as polyisobutylene is applied as layers 50, 52 and 54 at each of the points at which gas could enter or leave the unit around or through the spacer. This use of seal 50, 52 and 54 eliminates outer seal 46 and is quite durable since the seals are shielded from possible tearing or the like.

Figure 8:
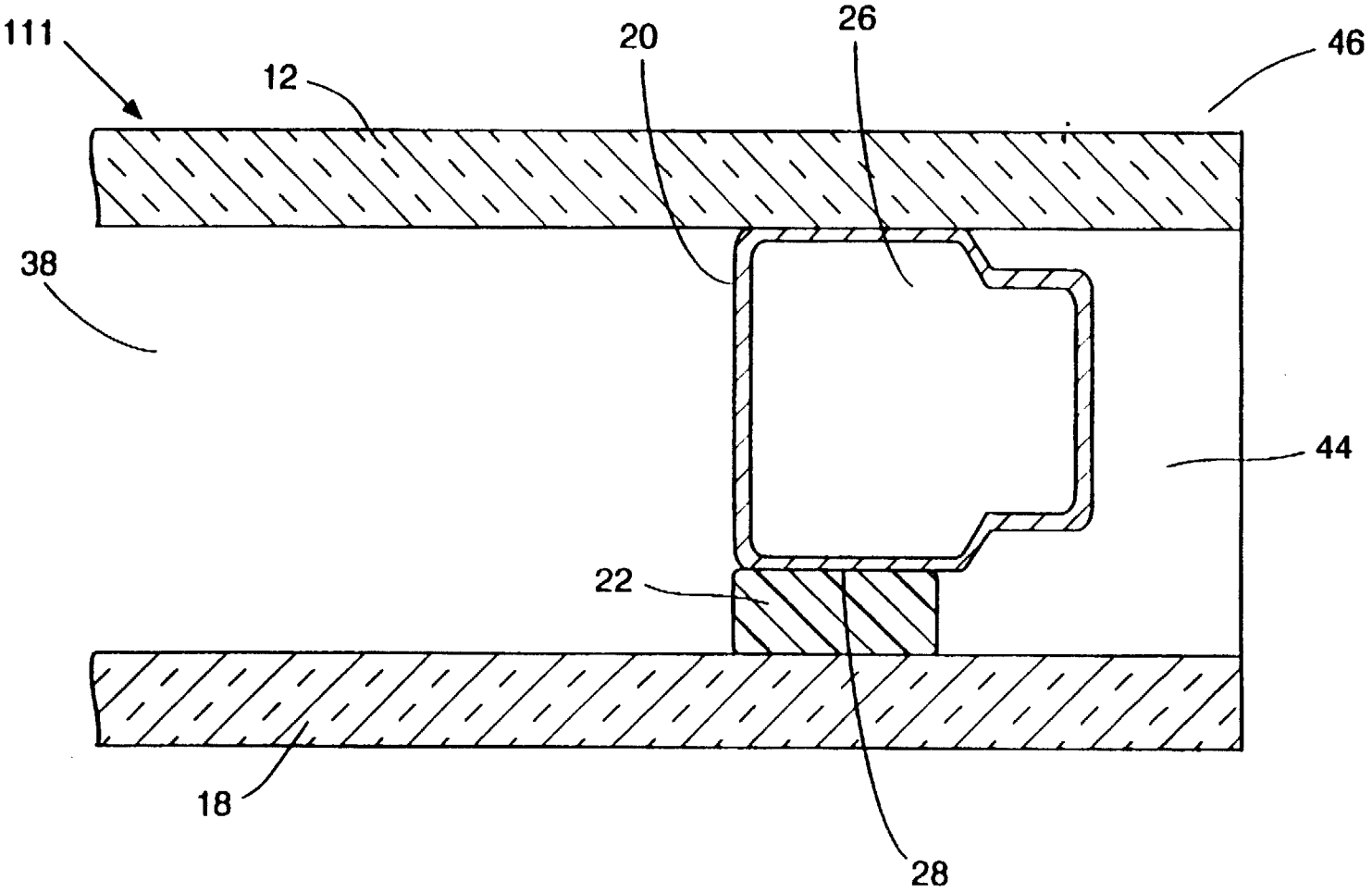

As illustrated by structure 108 shown in FIG. 8, foam spacer 22 need not be "centered" in the glazing unit but may be located "off center." Structure 108 is equivalent to structure 101.

Figure 9:
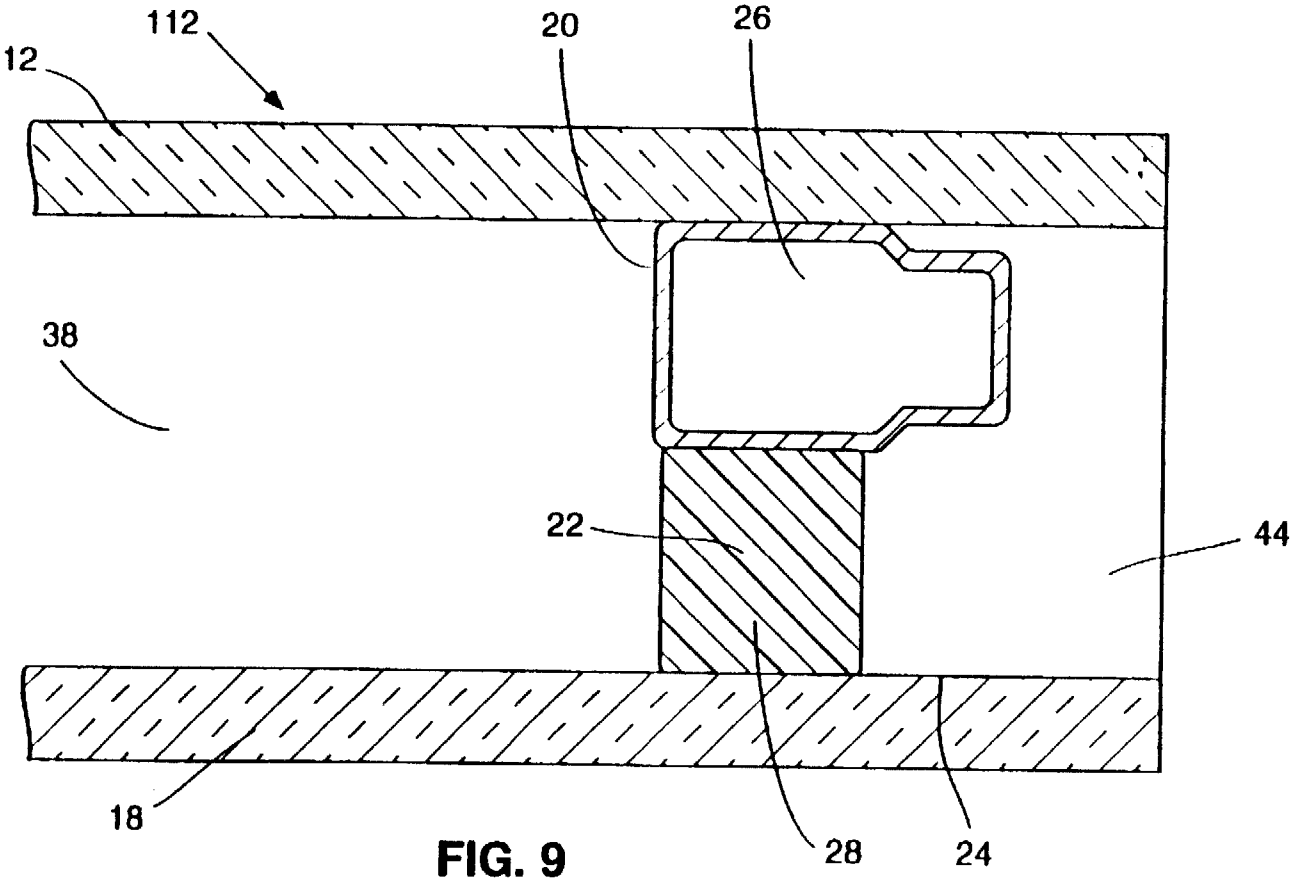

FIG. 9 shows structure 109 which is a "short foam spacer" analog of structure 108.

Figure 10:
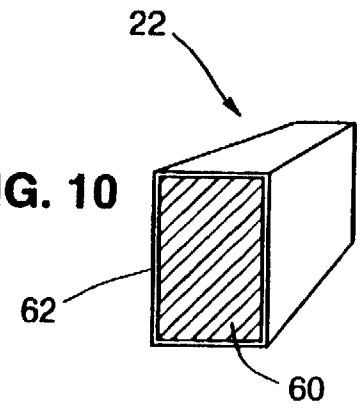

FIG. 10 shows structure 110 which is a "no outer seal" analog of structure 109. Again, this structure would be used if no gas filling were employed or could be supplemented by the use of gas-impermeable seals as shown in FIG. 7.

FIGS. 11 and 12 show structures 111 and 112, respectively, each of which are simplified applications of the closed cell foam spacer in window units. In structures 111 and 112, the interior film has been eliminated as in structures 104–107. In structures 111 and 112, the closed cell foam is paired with a single rigid spacer 20. The thickness of the closed cell foam 22 and the spacer 20 can be varied, as shown in FIGS. 11 and 12, to achieve the overall void thickness desired for thermal break properties. The structures of FIGS. 11 and 12 can be further varied such as by including an outer sealing tape or internal seals and gas fill, or by varying the width of the foam seal to extend through sealant 44 to the outer edge of the structure.

As these various figures show, the space between a given pair of glazing sheets is spanned by the combination of a closed cell foam element 22 and a nonfoam spacer element 20. As these figures show, the foam element can comprise from a small part of this distance to a substantial part.

Manufacturing method: In a typical mode of production, the window structures of the invention are assembled using adhesive, typically double-sided adhesive tape, to bond the various layers and spacers into their desired configuration. For example, in the case of structures 101–103, the manufacturing method could involve first affixing inner glazing sheet 16 coated with heat-reflecting film 16a to spacer 24 using double-sided adhesive tape. Spacers 22 and 24 are hollow and contain desiccant. Outer glass panes 12 and 18 are joined to their respective outer spacers 20 and 24, again with double-sided tape, to give a glass-spacer-film, and glass-spacer subassemblies. These two subassemblies are then joined using foam spacer 22 and additional adhesive tape, so that the pane edges are aligned. The edge of foam spacer 22 extends out beyond the edges of sheet 16 and is aligned with the edges of the outer panes 12 and 18 as shown in FIG. 1. Sealant 44 is introduced at the pane edges and allowed to cure; at this point the window units are subjected to a heat treatment. Typically, temperatures in the range of about 80° C. to about 120° C. are used. The heating period is generally about 30 minutes, although longer times are required at lower temperatures, and shorter times may be sufficient at higher temperatures. This heat treatment serves to cure the sealant 44 and shrink the internal plastic films 14 and 16 to a taut condition. Interpane gas spaces are then filled. The method of filling the structures with gas should be such that efficiency is maximized and gas loss is minimized. In a particularly preferred method of introducing the filling gas, delivery is carefully controlled, i.e., a timing device is used and the flow rate monitored so that filling will be stopped at a given volume. The gas fill mix is adjusted depending on the thickness of the window structure and on the desired R-value and introduced into the interpane gas structures using the desired method. The structure is re-sealed as above. The selected barrier tape 46 is then applied over the pane edges and sealant as illustrated in FIG. 1.

Similar production sequences will be used to prepare the other structures having the foam spacers of this invention.

It is to be understood that while the invention has been described in conjunction with the preferred specific embodiments thereof, that the foregoing description as well as the example which follows is intended to illustrate and not limit the scope of the invention. Other aspects, advantages and modifications within the scope of the invention will be apparent to those skilled in the art to which the invention pertains.

Experimental

Edge R-values were measured for several different multipane window structures, approximately 1" thick, fabricated as described in the preceding sections, except that the composition of the interior spacer was varied. A polyvinyl chloride spacer gave an edge R-value of 1.38, while a hollow aluminum spacer, an extruded butyl spacer, and a hollow fiberglass spacer gave edge R-values of 0.37, 0.56 and 0.68, respectively. As expected, the foamed polyvinyl chloride spacer, having a much lower thermal conductivity, gave the highest edge R-value.

We claim:

1. A multipane window glazing structure comprising three substantially parallel sheets of glazing held in spaced adjacent relationship to each other by peripheral spacers, the first and third of said three sheets of glazing being rigid glass or plastic and representing exterior faces of said structure and the second of said three sheets of glazing being a flexible transparent plastic sheet contained on the interior of said structure, the peripheral spacer between the first and second sheets of glazing comprised of a body of a physically stable closed cell foam polymer having a thermal conductivity of less than about 0.8 BTU/in×ft$^2$×hr×°F. extending around the periphery of the first and second glazing sheets and adhered to an additional spacer body having a hollow cross-sectional tubular structure which also extends around the periphery of the first and second glazing sheets, said additional spacer body being formed from a material other than physically stable closed cell foam polymer, said additional spacer body and said closed cell foam body together sized to span the spaced relationship between the first and second sheets of glazing with one of said closed cell foam body and said additional spacer body being adhered to the first glazing sheet and the other of said closed cell foam body and said additional spacer body being adhered to the second glazing sheet.

2. The multipane window glazing structure of claim 1, wherein the thermal conductivity of the closed cell foamed polymer is less than about 0.5 BTU/in×ft$^2$×hr×°F.

3. The multipane window glazing structure of claim 1, wherein the thermal conductivity of the closed cell foamed polymer is less than about 0.2 BTU/in×ft$^2$×hr×°F.

4. The structure of claim 1, wherein the polymer is selected from the group consisting of foamed polycarbonate, foamed polyurethane, foamed polyphenylene oxide and foamed polyvinyl chloride.

5. The structure of claim 4 wherein the polymer has a density of from about 3.0 lb/ft$^3$ to about 25 lb/ft$^3$.

6. The structure of claim 1, wherein the flexible transparent plastic sheet is a flexible plastic film which carries a wavelength-selective, reflective coating on one of its surfaces.

7. The structure of claim 6, wherein the plastic film is comprised of polyethylene terephthalate.

8. The multipane glazing structure of claim 1 additionally comprising a peripheral seal surrounding and enclosing the edges of said sheets and the spacers, said peripheral seal comprising (a) a layer of curable sealant adhered to the edges of the sheets of glazing and to the outer surface of the spacers, and (b) a continuous gas-impermeable tape adhered to and overlaying said layer of sealant.

9. The multipane glazing structure of claim 8, wherein the sealant is a polyurethane.

10. The multipane glazing structure of claim 9, wherein the polymer has a density of at least about 3.0 lb/ft$^3$.

11. The multipane glazing structure of claim 1, wherein a gas selected to reduce heat transfer is contained and enclosed within said structure.

12. The multipane glazing structure of claim 11, wherein said gas is selected from the group consisting of krypton, argon, sulfur hexafluoride, carbon dioxide, and mixtures thereof.

13. The multipane glazing structure of claim 11 wherein said gas further contains oxygen in an amount of about 1.0 to 10% by volume.

* * * * *